US005353038A

United States Patent [19]

Osborne et al.

[11] Patent Number: 5,353,038

[45] Date of Patent: Oct. 4, 1994

[54] AUTOMATIC DIRECTION FINDER SENSE ANTENNA

[75] Inventors: Gregory W. Osborne, Mansfield; Leon Hardman, Bedford, both of Tex.

[73] Assignee: Bell Helicopter Textron Inc., Fort Worth, Tex.

[21] Appl. No.: 205,350

[22] Filed: Mar. 3, 1994

Related U.S. Application Data

[63] Continuation of Ser. No. 881,600, May 12, 1992, abandoned, which is a continuation of Ser. No. 571,565, Apr. 8, 1991, abandoned.

[51] Int. Cl.[5] ..... H01Q 1/28; H01Q 13/12

[52] U.S. Cl. ..... 343/708; 343/767; 343/769

[58] Field of Search ..... 343/708, 767, 770, 771, 343/769, 768; H01Q 1/28, 13/12

[56] References Cited

U.S. PATENT DOCUMENTS

| | | | |
|---|---|---|---|
| 2,977,595 | 3/1961 | Zisler et al. | 343/767 |
| 3,086,204 | 4/1963 | Alford | 343/708 |
| 3,623,162 | 11/1971 | Whitty | 343/708 |
| 4,373,162 | 2/1983 | Peterson | 343/771 |
| 4,983,034 | 1/1991 | Spillman, Jr. | 356/32 |
| 5,170,367 | 12/1992 | Mackay et al. | 364/571.01 |

*Primary Examiner*—Donald Hajec
*Assistant Examiner*—Hoanganh Le
*Attorney, Agent, or Firm*—Richards, Medlock & Andrews

[57] ABSTRACT

A surface conforming sense antenna is integrated with the surface skin of an aircraft by removing a rectangular looped strip of a metallized exterior composite surface skin. The remaining interior metallized portion isolated from the exterior metallized section forms an antenna sense element. The inner metallized portion is connected to an ADF radio receiver to function as a sense antenna in conjunction with a loop antenna. The gap between the metallized inner portion of the exterior metallized section allows lightning energy to be discharged thereacross. The modification does not impose a weight penalty or a wind drag penalty and does not degrade lightning protection for the composite aircraft.

19 Claims, 2 Drawing Sheets

AUTOMATIC DIRECTION FINDER SENSE ANTENNA

This application is continuation application of Ser. No. 07/881,600, filed on May 12.1992, which is a continuation of Ser. No. 07/571,565, filed on Apr. 8,1991, both abandoned.

TECHNICAL FIELD OF THE INVENTION

The present invention relates in general to aircraft radio antenna systems formed in the exterior skin of composite aircraft, and more particularly relates to the integration of an automatic direction finding sense antenna with metallized structures in aircraft of the type employing composite construction airfoils and skins.

BACKGROUND OF THE INVENTION

Direction finding is one of the oldest and most widely used form of navigational aid. The direction of a transmitter with respect to an aircraft may be determined by comparing the arrival time of its transmission at two or more known points. In the simplest practical system, these two points are the vertical arms of a loop antenna connected to a receiver. As the loop is rotated, the received signals cancel each other when the plane of the loop is at right angles to a radial extended to the transmitter station. The major disadvantage of loop antenna direction finding systems is the 180-degree ambiguity problem, wherein the loop antenna can determine the bearing (i.e., the radial along which the transmitter is located), but cannot determine the direction (i.e., whether the transmitter is in front of or behind the, receiver).

An Automatic Direction Finder is a device used as an aid to determine the geographical location of the aircraft relative to a ground-based omnidirectional radio transmitter. However, in order to resolve the 180-degree ambiguity which results from the use of a primary loop antenna for determining direction, additional antennas must be used. One such additional or supplemental antenna commonly used is a "sense" antenna. Additional sense antennas can be conveniently attached to the metal surfaces of conventional aircraft to assist in resolving the ambiguity problem. However, in newer types of aircraft having composite skin structures, the attachment thereto of radio antennas is more troublesome. In particular, conventional antennas cannot be attached to the exterior surface of a composite aircraft without exacting a weight penalty, a wind drag penalty, or other disadvantage. U.S. Pat. No. 4,507,341 describes the problems and a solution in attaching the base of an aerial type of radio antenna to a composite fiber-resin type of skin and achieve a low resistance therebetween.

It is therefore an objective of the present invention to efficiently and economically provide a sense antenna to be used on composite aircraft which conforms to the shape of the aircraft skin. It is also an object of the present invention to utilize a metallized portion of the composite aircraft as an antenna element for an Automatic Direction Finder navigation receiver.

SUMMARY OF THE INVENTION

The invention provides for a conformal sense antenna which is embedded or attached to or in the composite skin of an aircraft. By removing a uniformly wide strip of a metallized portion of the composite surface skin to form a rectangular closed-loop slot, a sense antenna is formed. The isolated area interior to the removed part serves as an antenna element for an Automatic Direction Finder navigation receiver. Alternatively, a portion of the metallized composite surface skin can be removed and replaced with another antenna sense element which is shaped so that, when placed and fixed in the opened area in the composite surface skin, a gap of uniform width is formed between the antenna sense element and the perimeter or outer circumference of the metallized composite surface skin.

According to the present invention, the main body of the composite aircraft serves as a ground plane for the sense antenna system, while the isolated interior portion functions as the sense antenna itself to receive the transmitted signal. The received signal causes the capacitance between the isolated interior antenna element and the exterior metallized portion of the composite surface skin to change. Detected changes in the capacitance are amplified and electrically communicated to an Automatic Direction Finder receiver located in the aircraft. These signals are combined with signals received from a conventional primary loop antenna for determining the bearing and direction of the aircraft with respect to the transmitter station.

BRIEF DESCRIPTION OFT HE DRAWINGS

For a more complete understanding of the present invention and the advantages thereof, reference is made to the following description of the accompanying drawings in which.

DETAILED DESCRIPTION OF THE INVENTION

With reference to the drawings, there is depicted and described a novel Automatic Direction Finder (ADF) sense antenna for composite aircraft which utilizes for an ADF sense antenna a portion of the aircraft's lightning protection material that is isolated from the remainder thereof by a small gap. Although the following description depicts a sense antenna which is formed in the lightning protection system of a composite aircraft, it will be appreciated that the sense antenna can be formed in any metallized portion of the exterior composite surface skin, even if such portion is not part of the lightning protection system.

The present invention provides a-novel design for sense antennas in composite aircraft wherein a closed-loop strip of metallized material of the composite aircraft is removed to define an interior isolated portion which functions as an antenna element. The use of the isolated metallized area to provide a sense antenna exacts no weight penalty or wind drag penalty, and provides a conforming antenna where conventional antennas would not be feasible. Thus, the unique design of the conformal sense antenna of the present invention functions as a supplementary antenna which can be used to resolve the 180 degree ambiguity associated with primary loop antenna detection.

Figure 1:
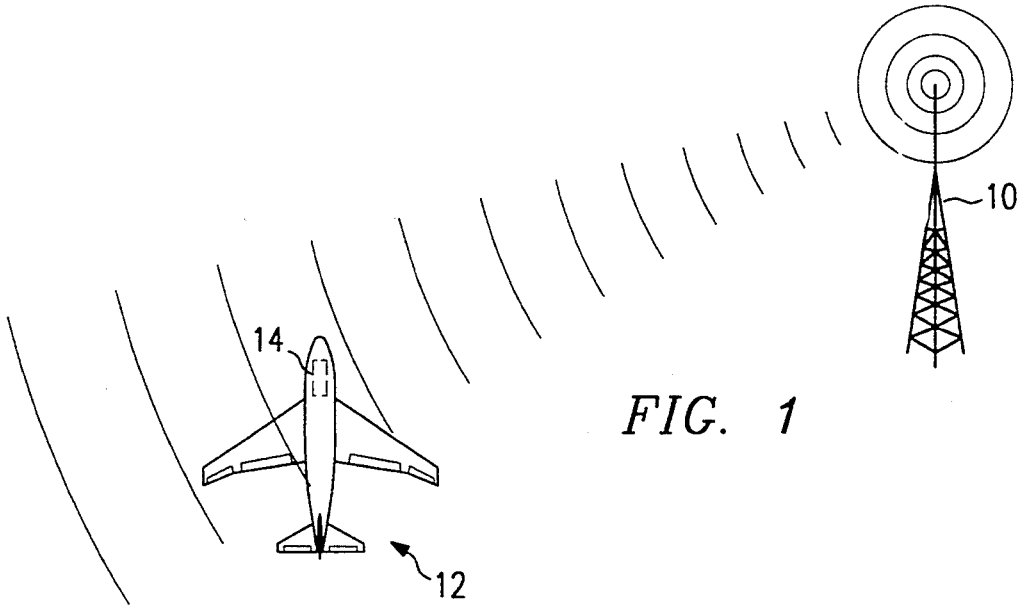
FIG. 1 is a perspective view of an aircraft with the sense antenna of the present invention mounted thereunder.

FIG. 1 shows an aerial view of a radio transmitter station 10, defining a navigational aid, and an airplane 12 equipped with the sense antenna 14 of the present invention. For purposes of example, if the aircraft 12 were flying a northerly heading, the needle pointer of a compass type gauge of the ADF system would point to the north-east (45°) to indicate that the radio navigation station 10 is situated at such a bearing. Were it not for the use of a sense antenna operating in conjunction with a primary loop antenna of the ADF system, such system could not resolve whether the station 10 was located to the north-east or to the south-west. Of course, conventional ADF system gauge dials are accurately calibrated in degrees (0°–360°) for accurate resolution of the geographical location of the aircraft.

Figure 2:
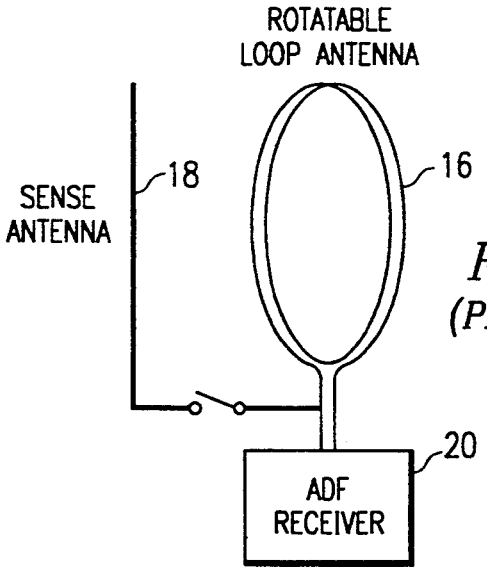
FIG. 2 (PRIOR ART)
FIG. 2 shows a sense antenna and loop antenna associated with a direction finding receiver.

In FIG. 2 there is shown a schematic illustration of a well-known rotatable loop antenna 16 and a sense antenna 18 as utilized by a conventional Automatic Direction Finder receiver 20. As noted above, the loop antenna 16 by itself can provide the bearing to the transmitter 10, but cannot always indicate the direction from which the transmitter 10 is transmitting because of the 180-degree ambiguity problem. Free standing or aerial type of sense antennas 18 are widely used as corrective antenna systems which, when operating in conjunction with a primary loop antenna 16, exhibit a cardioid pattern characteristic 22, as shown in FIG. 3.

The pattern 24 (A and B) for the loop antenna, which detects the magnetic field of the transmitted signal, has two nulls 26, which are 180 degrees apart. As the loop antenna 16 is rotated, the received signals cancel each other when the plane of the loop 16 is at a right angle to a radial extending to the transmitting station 10. The pattern C associated with the sense antenna 18 is identified with reference numeral 28. Although the use of a sense antenna 18 to resolve this 180-degree ambiguity is widely known in the art, the particular design of the present invention provides a novel conformal sense antenna especially well adapted for use with composite aircraft skins.

Figure 3:
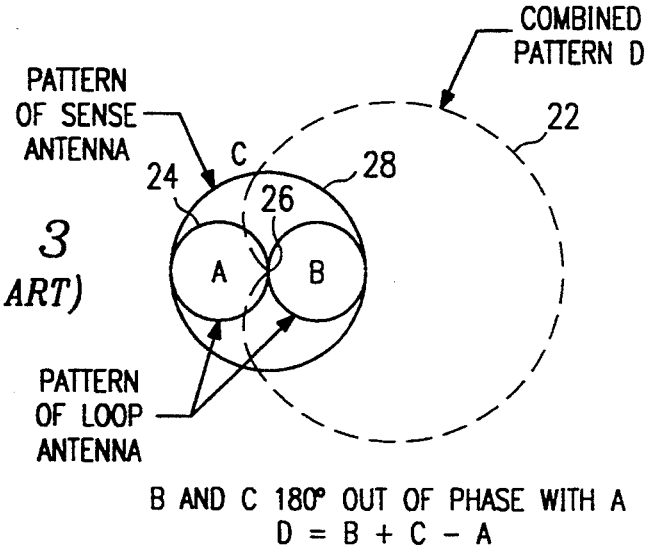
FIG. 3 (PRIOR ART)
FIG. 3 shows the cardioid pattern resulting from the combination of the sense antenna signal and the loop antenna signal.

As shown in FIG. 3, the patterns from the sense antenna 18 and loop antenna 16 can be combined to achieve the cardioid pattern 22, by adding pattern B and pattern C, and then subtracting pattern A (which is 180-degrees out of phase with patterns B and C). The sense antenna 18 detects the electronic field of the transmitted signal which is 90-degrees out of phase with the magnetic field of the transmitted signal. The resulting cardioid pattern 22 can be used to determine not only the bearing but also the exact direction of the transmitter 10 with respect to the aircraft 12.

Figure 4:
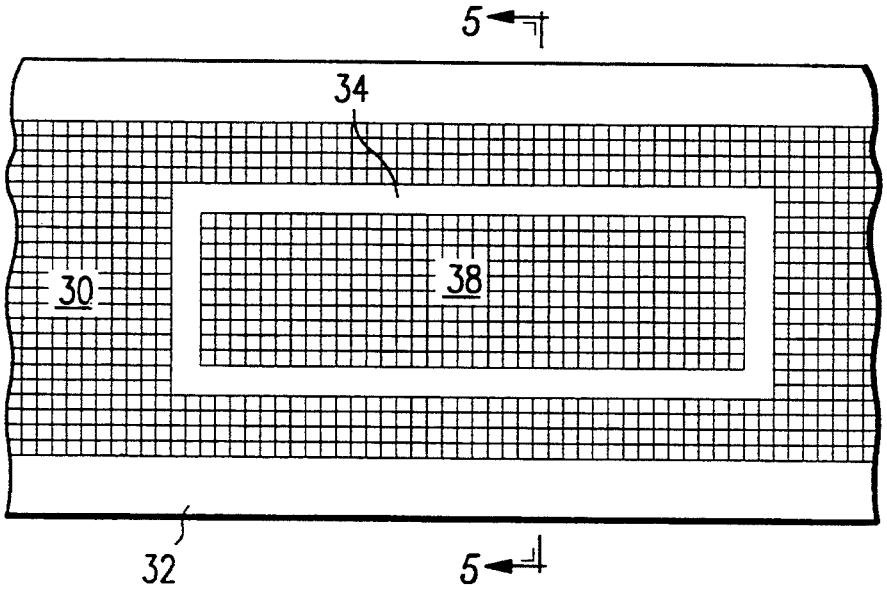
FIG. 4 illustrates a fragmentary view showing the underside of an aircraft with the sense antenna constructed in accordance with a first embodiment of the present invention.

The utilization of the ADF sense antenna of the invention is well adapted for use with composite skin type of aircraft. Indeed, the sense antenna of the invention can be efficiently incorporated with lightning protection equipment, and especially the type conductive screen or foil employed with composite skin aircraft structures. Reference is now made to FIG. 4 where there is illustrated a lightning protection screen 30 which is embedded within the skin 32 of a composite aircraft structure. The screen 30 functions as a conductor to carry away or dissipate energy and thus protect the aircraft during lightning strikes. The construction of such a screen in a composite skin structure is well known in the art and need not be further detailed here. The lightning conductor material 30 is generally a sheet material formed or fastened to the exterior surface of the composite superstructure. Resin bonded carbon fibers comprise a well-known type of composite aircraft skin.

The sense antenna input of the Automatic Direction Finder is electrically connected to an isolated inner screen portion 38, while the "ground" or common input of the ADF receiver is electrically connected to the metallized outer screen portion 30 which provides the lightning protection. In order to provide an electrical conductor between the inner screen conductive portion 38, or the sense antenna, and the ADF receiver, conducting wires or cables are connected to the sense antenna by running wires from the ADF through the exterior skin of the aircraft. For instance, a coaxial or similar type of cable 40 can be utilized. The braided sheath 42 of the cable 40 is connected to the major part of the screening 30, while the inner conductor 44 is connected to the sense antenna 38. The conductors 42 and 44 are preferably soldered or welded to the respective screening conductors 30 and 38. Alternatively, electrical connections can be made to the screen material in a manner similar to that described in U.S. Pat No. 4,507,341.

As can be appreciated, the sense antenna 38 can be located at a convenient location of the aircraft body or airfoils, taking into consideration the location of the rotatable loop antenna. If the sense antenna 38 of the present invention is mounted on top of the aircraft, the wiring to the Automatic Direction Finder receiver would be switched so that the conductor connected to the isolated inner portion 38 would connect with the ADF receiver's ground input port, while the conductor connected to the lightning strike screening 30 would connect with the ADF receiver sense antenna input port.

Figure 5:
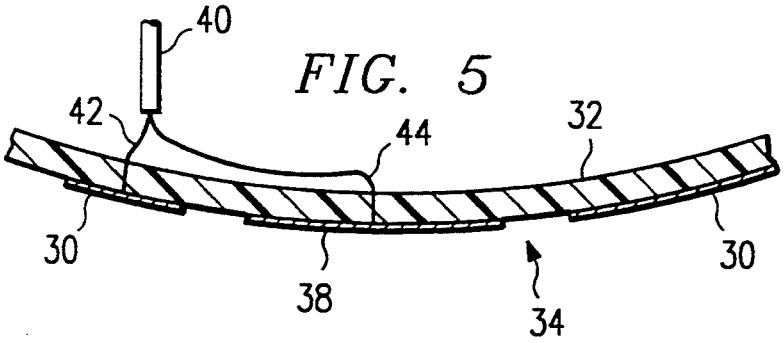
FIG. 5 is a cross-sectional view of the composite aircraft skin, taken along line 5—5 of FIG. 4.

More particularly, FIGS. 4 and 5 illustrate the sense antenna 38 of a first embodiment of the present invention in which a rectangular closed-loop strip 34 of width Wg of two inches is removed from the lightning strike screening 30. While a rectangular shaped sense antenna is illustrated, different shapes can be obtained by removing a correspondingly shaped closed-loop strip of the screening material. In any event, by removing a border strip 34 of the screening 30, a rectangular-shaped inner portion 38 remains, which inner portion is electrically isolated from the outer part of the lightning strike screening 30. After severing the screening to form the inner portion 38, the loose ends of the screening material can be epoxied or bonded so that the leading edges of the screening do not separate from the composite superstructure during high speed flight. Preferably, the entire area is resealed to provide an aerodynamically smooth surface.

After removal of the rectangular strip 34 of the width Wg of two inches, the rectangular strip 34 has an inner circumference and an outer circumference. The isolated inner portion 38 defines a sense antenna structure which conforms to the shape of the aircraft and which does not exact a weight penalty or wind drag penalty. In addition, and to be described more fully below, the sense antenna function of the isolated inner portion 38 can be combined in function with the lightning protection systems typically employed in composite airframes.

The two-inch strip 34 defines an isolating gap which is sufficiently narrow to provide a spark gap so that lightning protection is not degraded. With a gap 34 of no more than about two inches, lightning strikes to the inner portion 38 can be conducted across the gap 34 and be safely carried away or dissipated by the surrounding screening 30 and other components associated with the lightning protection system.

Accordingly, the function of the lightning protection system is not compromised, and in addition the conductive screening material provides sense antenna functions for the ADF system.

Figure 6:
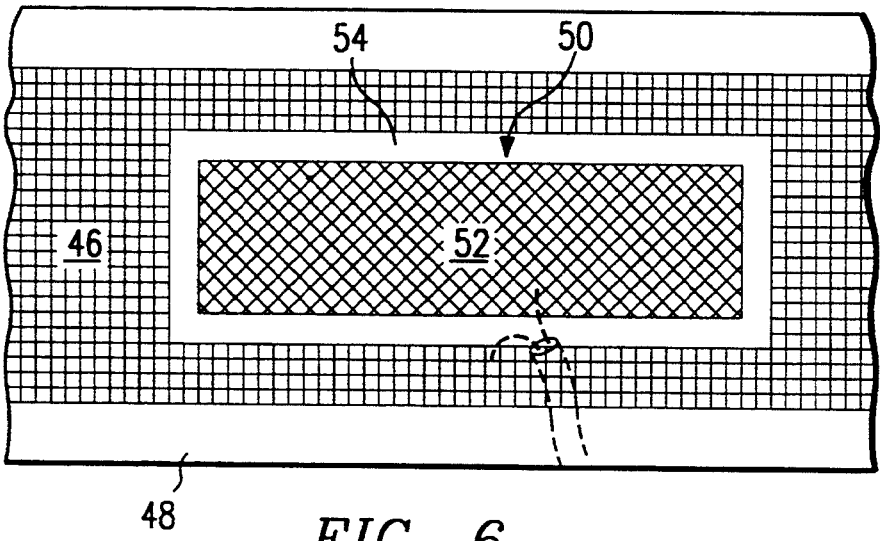
FIG. 6 shows a second embodiment of the present invention.

FIG. 6 depicts a second embodiment of the present invention wherein a portion of the metallized screen 46 of the exterior composite surface skin 48 is entirely removed from the aircraft to form an entire interior opening 50. A sense antenna element 52 of the same or different conductive material is then bonded or otherwise fixed in the opening 50. The sense antenna has a defined circumference depending upon the size of the opened area 50 and the width of the gap 54. Again, a gap 54 or electrically insulated strip of about two inches peripherally borders the sense antenna element 52. The thickness of the sense antenna element 52 is preferably about the same as the thickness of the removed portion so that when fixed in the opening 50, the sense antenna element 52 closely conforms to the surface shape of the aircraft. The sense antenna element 52 can be formed of any suitable conductive material, such as aluminum wire mesh or foil.

In the various embodiments of the present invention, uniformity of gap width or slot width is of importance in that the sense antenna of the present invention operates as an electronic field antenna, as opposed to a loop antenna which operates as a magnetic field antenna. The electronic field of the transmitter signal is detected by the sense antenna as a function of the capacitance between the isolated inner portion/sense antenna element and the remainder of the metallized composite aircraft skin.

Because of the capacitive behavior of the sense antenna, it is not critical that the shape of the opening (and therefore the sense antenna element) be rectangular in shape. In the preferred embodiment of the invention, as shown in FIG. 4, the isolated sense antenna element 38 is formed so as to define a rectangular element having dimensions of length la of about 45.0 inches long by a width of Wa of about 13.5 inches wide, and an outer circumference (i.e., the perimeter of the opening) having dimensions of about 49.0 inches long by about 17.5 inches wide.

In summary, there is disclosed herein a surface-conforming sense antenna for use with an Automatic Direction Finder navigation receiver which is embedded in or disposed on the "skin" of a composite aircraft. The invention utilizes a portion of the lightning protection material of the composite aircraft and thus additional material is not required. Alternatively, an antenna sense element of suitable material, such as aluminum mesh, is bonded within an opened area formed within the lightning protection screening. The isolated screen portion, or sense antenna element, is isolated from the remainder of the lightning protection material by a spark gap. The isolated area provides a sense antenna which closely conforms to the shape of the airframe and assists in the resolution of the 180-degree ambiguity from the loop antenna detection of a transmitted signal, but does not exact a weight penalty because the antenna can be combined in function with the lightning protection system required in composite aircraft.

While the invention has been described above in connection with the fabrication of an ADF sense antenna, the principles and concepts of the invention can be employed to construct other types of antennas in composite type of aircraft skins. In addition, the techniques of the invention can be utilized not only in modifying existing composite aircraft structures, but also in constructing and building new aircraft antenna structures.

The accompanying Drawings and foregoing Detailed Description illustrate and describe a number of embodiments of the present invention, but it will be understood that the invention is not limited to the embodiments disclosed, but is capable of numerous rearrangements, modifications and substitutions, without departing from the scope of the invention.

We claim:

1. A conformal antenna for composite aircraft structures, comprising:

a first metallized conductor having a first electrical conductance disposed on an exterior surface of a composite structure said first metallized conductor having an opened area formed therein of a given peripheral shape and circumference, and a second metallized conductor having a second electrical conductance disposed on the exterior surface of said composite structure being fixed within an opened area of said first metallized conductor wherein said second electrical conductance differs from said first electrical conductance, and having a surface shape generally conforming with the exterior surface of the composite structure, said second metallized conductor being smaller than the circumference of the opened area and being disposed within the opened area such that there is a peripheral gap between the peripheral edge of said opened area of said first metallized conductor and the peripheral edge of the second metallized conductor wherein said gap is generally uniform in width and sufficiently narrow to allow lightning energy to be discharged thereacross.

2. The conformal antenna of claim 1 wherein said first metallized conductor and said second metallized conductor are different physical structures of the same metal wherein the physical structure of the metal causes the difference in conductances.

3. The conformal antenna of claim 2 wherein said second metallized conductor is formed of a solid metal sheet and said first metallized conductor is formed of a wire mesh.

4. The conformal antenna of claim 1 wherein said first and second metallized conductors are formed with different types of metal having different conductances.

5. The conformal antenna of claim 1 wherein said second metallized conductor and the opened area formed in said first metallized conductor are rectangular in shape.

6. The conformal antenna of claim 1 wherein said first and second metallized conductors comprises a sense antenna for use in combination a rotatable loop antenna for ascertaining directional bearings of the aircraft.

7. The conformal antenna of claim 1 wherein said second metallized conductor possesses a higher conductance than said first metallized conductor.

8. An antenna system for an aircraft having composite structures, comprising:

an airframe having a composite exterior surface;

a first metallized conductor on the exterior surface of said composite structure having formed therein an opened area which is rectangular in shape;

a second metallized conductor on the exterior surface of said composite structure composed of a different material than said first metallized conductor and being shaped with a defined circumference within the opened area in the first metallized conductor and generally conformal with the exterior surface of said composite structure, said defined circumference of said second metallized conductor being smaller than the circumference of the opened area in the first metallized conductor, and said second metallized conductor being shaped and positioned so that a gap of generally uniform width exists between a peripheral edge of the second metallized conductor and the opened area of the first metallized conductor sufficient to allow lightning energy to be discharged thereacross;

an automatic direction finder receiver electrically connected to said first and second metallized conductors capable of detecting changes in capacitance of said first and second metallized conductors; and a primary loop antenna attached to the aircraft and electrically connected to said automatic direction finder receiver.

9. The antenna systems of claim 8 wherein said first and second metallized conductors are different types of metal having different conductances.

10. The antenna system of claim 8 wherein said second metallized conductor is rectangular in shape.

11. The antenna system of claim 10 wherein the second metallized conductor is rectangular in shade and is about 45 inches long and about 13.5 inches wide.

12. A conformal sense antenna apparatus for composite aircraft comprising:

a primary antenna attached to an exterior composite surface of the aircraft for determining bearings of the aircraft;

a secondary antenna on the exterior composite surface of said aircraft having a first metallized conductor and a second metallized conductor separated by a closed loop gap of generally uniform width of no more than two inches and being sufficient in width to allow lighting energy to be discharged thereon, wherein said first metallized conductor possesses a different electrical conductance than said second metallized conductor;

an automatic direction finder receiver electrically connected to said secondary antenna to measure changes of capacitance and the primary antenna for determining directional bearings to a transmitting radio station.

13. The conformal sense antenna apparatus of claim 12 wherein the rectangular closed-loop nonconductive gap has outer circumference dimensions of about 49 inches by about 17.5 inches, and inner circumference dimensions of about 45 inches by about 13.5 inches.

14. A method for making a conformal sense antenna on the exterior surface of a composite aircraft structure, comprising the steps of:

placing a first metallized conductor on the exterior surface of the composite aircraft structure;

removing a first portion from the first metallized conductor so as to form an outer conductor with an open area;

placing a second metallized conductor composed of a different material than said first metallized conductor in said open area such that a gap is present between said first and second metallized conductor; and connecting said first metallized conductor and said second metallized conductor to ADF radio equipment.

15. The method of claim 14 wherein the gap between the first and second conductors has a width which allows a lightning strike to be discharged across the gap.

16. The method of claim 14 further including connecting the outer conductor to a common ground.

17. The method of claim 14 wherein said removal of the first portion from said first metallized conductor is performed by cutting the first metallized conductor without substantially affecting the structural integrity of the composite material.

18. The method of making a conformal sense antenna of claim 14 wherein said second metallized conductor is composed of the same metal type as said first metallized conductor.

19. The method of making a conformal sense antenna of claim 14 wherein said second metallized conductor is formed of a solid metal sheet and said first metallized conductor is formed of a wire mesh.

* * * * *

UNITED STATES PATENT AND TRADEMARK OFFICE

CERTIFICATE OF CORRECTION

PATENT NO. : 5,353,038

DATED : October 4, 1994

INVENTOR(S) : Osborne et al.

It is certified that error appears in the above-indentified patent and that said Letters Patent is hereby corrected as shown below:

Column 1, Background of the Invention, line 33, delete the -- , --.

Column 2, Detailed Description, line 62, delete the "hyphen (-)" between --a-novel--.

Column 5, line 47, delete the word --long--.

Column 5, line 48, delete the word --wide--.

Signed and Sealed this

Thirty-first Day of January, 1995

*Attest:*

Bruce Lehman

BRUCE LEHMAN

*Attesting Officer*

*Commissioner of Patents and Trademarks*